US007315700B2

(12) United States Patent
Kim et al.

(10) Patent No.: US 7,315,700 B2
(45) Date of Patent: Jan. 1, 2008

(54) IMAGE FORMING APPARATUS CAPABLE OF OPTIMUM OUTPUTTING ACCORDING TO THE GRADE OF CONSUMABLES

(75) Inventors: Yong-geun Kim, Suwon-si (KR); Jeong-soo Han, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/852,262

(22) Filed: May 25, 2004

(65) Prior Publication Data

US 2005/0008375 A1 Jan. 13, 2005

(30) Foreign Application Priority Data

Jul. 9, 2003 (KR) ..... 10-2003-0046554
Dec. 1, 2003 (KR) ..... 10-2003-0086567

(51) Int. Cl.
*G03G 15/00* (2006.01)

(52) U.S. Cl. ..... 399/12; 399/24

(58) Field of Classification Search ..... 399/12, 399/31, 24, 25, 26, 27, 29
See application file for complete search history.

(56) References Cited

U.S. PATENT DOCUMENTS 5,132,729 A * 7/1992 Matsushita et al. ..... 399/24
5,699,091 A * 12/1997 Bullock et al. ..... 347/19
5,812,156 A 9/1998 Bullock et al.
6,438,329 B1 * 8/2002 Budnik et al. ..... 399/24
6,707,480 B2 * 3/2004 Ameyama et al. ..... 347/129
2002/0127020 A1 * 9/2002 Childers ..... 399/12
2002/0159778 A1 * 10/2002 Kida ..... 399/12

FOREIGN PATENT DOCUMENTS

| | | |
|---|---|---|
| CN | 1364248 A | 8/2002 |
| EP | 1 184 734 A1 | 3/2002 |
| JP | P11-129498 | 5/1999 |
| JP | 2000-330432 | 11/2000 |
| JP | 2002-062784 | 2/2002 |
| JP | 2002-202643 | 7/2002 |
| JP | 2002-341705 | 11/2002 |
| KR | 1996-018783 | 6/1996 |

* cited by examiner

*Primary Examiner*—Robert Beatty
(74) *Attorney, Agent, or Firm*—Roylance, Abrams, Berdo & Goodman, LLP

(57) ABSTRACT

An image forming apparatus capable of satisfying various demands of a user by enabling the user to determine a grade of consumables in a single image forming apparatus, and the method of employing the same. The printing method of an image forming apparatus which has a recognition device to print according to grades of consumables, comprises the steps of checking a grade of at least one consumable by the recognition device, searching a setup condition of the apparatus, through which the optimum printing can be obtained by combining the mounted consumables, setting up a printing condition which is preset by the combination of the consumables, and printing with the setup condition by a user's printing command. The image forming apparatus that operates according to grades of consumables, comprises a recognition device capable of recognizing the grades of the consumables, a memory storing image printing information with respect to combinations of the plurality of consumables, and a main control unit the determines the grades of the consumables through the recognition device, and prints the image with the information read from the memory.

9 Claims, 5 Drawing Sheets

| LIST | TONER | DEVELOPING ROLLER | TRANSFER ROLLER | BIAS(V) | LASER POWER(mA) | FUSING TERMPERATURE(°C) |
|---|---|---|---|---|---|---|
| A | ⓐ | ① | ① | 500 | 0.11 | 230 |
| B | ⓐ | ① | ② | 510 | 0.11 | 240 |
| C | ⓐ | ② | ① | 520 | 0.12 | 245 |
| D | ⓐ | ② | ② | 530 | 0.13 | 240 |
| E | ⓑ | ① | ① | 540 | 0.13 | 250 |
| F | ⓑ | ① | ② | 550 | 0.13 | 255 |
| G | ⓑ | ② | ① | 560 | 0.14 | 260 |
| H | ⓑ | ② | ② | 570 | 0.14 | 270 |

| LIST | TONER | DEVELOPING ROLLER | TRANSFER ROLLER | BIAS(V) | LASER POWER(mA) | FUSING TERMPERATURE(°C) |
|---|---|---|---|---|---|---|
| A | ⓐ | ① | ① | 500 | 0.11 | 230 |
| B | ⓐ | ① | ② | 510 | 0.11 | 240 |
| C | ⓐ | ② | ① | 520 | 0.12 | 245 |
| D | ⓐ | ② | ② | 530 | 0.13 | 240 |
| E | ⓑ | ① | ① | 540 | 0.13 | 250 |
| F | ⓑ | ① | ② | 550 | 0.13 | 255 |
| G | ⓑ | ② | ① | 560 | 0.14 | 260 |
| H | ⓑ | ② | ② | 570 | 0.14 | 270 |

IMAGE FORMING APPARATUS CAPABLE OF OPTIMUM OUTPUTTING ACCORDING TO THE GRADE OF CONSUMABLES

CROSS-REFERENCE TO RELATED APPLICATIONS

This application claims the benefit of Korean Patent Application No. 2003-46554, filed Jul. 9, 2003, and Korean Patent Application No. 2003-86567, filed Dec. 1, 2003, in the Korean Intellectual Property Office, the contents of both of which are incorporated herein by reference.

BACKGROUND OF THE INVENTION

1. Field of the Invention

The present invention relates to an image forming apparatus which processes data input by a user and outputs the data on paper. More specifically, the present invention relates to a device which selectively uses consumables of the image forming apparatus to satisfy particular demands of the user, and a method of optimizing the use the consumables.

2. Description of the Related Art

Image forming apparatuses such as printers, photocopiers, and facsimile machines generally include a plurality of removable parts held in a single casing. For example, an electrophotographic printer comprises a developing roller, a toner cartridge, a transfer roller, all of which are removable. Therefore, each of the parts can be replaced with a new one whenever necessary. This can occur, for example, when the life span of any of these parts has expired. These parts are generally called 'consumables'.

Referring to FIG. 1, a laser beam printer will now be described as an example of general image forming apparatus. The general laser beam printer 100 is comprised of a video part unit 110 and an engine control unit 130. The video part unit (video unit) 110 converts data received from an external device, such as a host computer, into image data of a bitmap format. The engine control unit 130 controls the operation of an engine mechanism 150 in printing the image data by control of the video unit 110.

The video unit 110 and the engine control unit 130 are usually operated by a single processor. The single processor usually is a microprocessor in a central processing unit (CPU), which supports a multi-process operating system (OS), and is provided in a main control unit 117. Accordingly, the video unit 110 and the engine control unit 130 are provided in a single printed circuit board (PCB). For the engine control unit 130, an application specific integrated circuit (ASIC) is typically used, which comprises a memory 132 for storing status information of the engine mechanism 150. The engine control unit 130 controls the operation of the engine mechanism 150 by the main control unit 117.

The engine control unit 130 is directly connected to the CPU 118 in the main control unit 117 through a system bus 120. The system bus 120 comprises an address bus, a control bus, and a data bus. A bi-directional parallel bus can be used for the data bus.

The video unit 110 comprises an operation panel 119, a computer interface (I/F) 113, a memory unit 115, and the main control unit 117.

The operation panel 119 comprises an input unit which has a plurality of keys for selection or setup of functions of the laser beam printer 100, and a display unit which displays operation status information of the laser beam printer 100 by a control of the main control unit 117.

The computer I/F 113 is connected between the host computer and the main control unit 117 to interface input/output signals. For the computer I/F 113, interfaces such as an IEEE1284, a USB, and an RS232C can be employed.

The memory unit 115 comprises a read-only memory (ROM) and a random-access memory (RAM). The ROM stores control programs and a variety of application programs to operate the main control unit 117. The RAM temporarily stores the printing data received from the host computer through the computer I/F 113, and other various data generated during the execution of the programs of the main control unit 117.

The main control unit 117 is comprised of the CPU 118 which controls the operation of the video unit 110 and the engine mechanism 150 by the control programs stored in the memory unit 115. Upon receiving a file to print from the host computer through the computer I/F 113, the main control unit 117 generates a display list to convert the received data to a frame data. The main control unit 117 also compensates the color of the data into yellow-magenta-cyan-black (YMCK), and stores the compensated color data in the memory unit 115. The main control unit 117 then generates the image data of a bitmap format in respective colors out of the data stored in the memory unit 115. After the bitmap data is generated, the main control unit 117 transmits a command to the engine control unit 130 to inform it to start the printing work.

The main control unit 117 considers the engine control unit 130 as a device to control, and therefore, reads and writes predetermined information with respect to the engine control unit 130 through the system bus 120. For example, when reading the predetermined information from the engine control unit 130, the main control unit 117 reads the status information. Alternatively, when writing the predetermined information, the main control unit 117 writes the command information to the engine control unit 130.

The engine control unit 130 uses the ASIC, and controls the operation of the engine mechanism 150 by the main control unit 117, as stated above. The engine control unit 130 receives the image data transmitted from the main control unit 117 through the system bus 120, and decodes the image data. According to the result of the decoded data, the engine control unit 130 generates a pattern with respect to the image to be generated by the engine mechanism 150, and based on the pattern, controls the driving of the engine mechanism 150.

The engine mechanism 150 comprises a paper supply unit 151, laser scanning unit (LSU) 152*a*, a LSU driving unit 152, a developing unit 153, a transferring unit 154, a fusing unit 155 and a sensing unit 156. The paper supply unit 151 picks up paper stacked in a paper supply cassette (not shown) sheet by sheet according to a paper supply signal received from the engine control unit 130. The LSU 152*a* forms a predetermined electrostatic latent image on a photoconductive drum (not shown) by scanning a laser beam corresponding to the image data onto the photoconductive drum. The developing unit 153 develops the electrostatic latent image by supplying toner to the photoconductive drum. The transferring unit 154 transfers the toner image formed on the photoconductive drum to the supplied paper. The fusing unit 155 fuses the toner image transferred on the paper, by heat and pressure.

The image forming apparatus described above usually checks its consumables, such as the toner, the developing roller, and the transfer roller, for the management of the lifespan, or compatibility of the consumables. Since consumables are typically applicable only to a corresponding image forming apparatus, compatibility of the consumables is quite low. Typically, therefore, a printer of a first company cannot output high quality prints using the consumables of different grades (or different companies). An exemplary embodiment to solve the above problem is disclosed in JP 2000-330432 (hereinafter, referred to as 'Japanese prior art'), the entire contents of which are incorporated herein by reference. In the Japanese prior art, the consumables of the image forming apparatus comprise data that the apparatus can read and record, or a program module that the apparatus can execute. The program module includes a program for obtaining required conditions when using the consumables. Although the Japanese prior art enables the general use of the consumables of different models, it does not provide any method or system to enable general use of consumables of various grades in a single printer. One user may want low cost rather than high quality of the printing, while another user may demand the high printing quality in spite of high cost. To satisfy such various demands, a plurality of printers were conventionally required. Accordingly, a need exists for the image forming apparatus according the embodiments of the present invention described below, which can meet users' various demands.

SUMMARY OF THE INVENTION

An object of the present invention is to solve at least the above problems and/or disadvantages and to provide at least the advantages described below. Accordingly, an object of the present invention is to provide an image forming apparatus which selectively uses consumables of different grades to satisfy particular demands of the user, and the method of selectively using consumables of different grades.

In order to achieve the above-described aspects of the present invention, there is provided a printing method of an image forming apparatus which has a recognition device to print according to grades of consumables, comprising checking a grade of at least one of the consumables by the recognition device, searching a setup condition of the apparatus, which can obtain the optimum printing by combining the mounted consumables, setting up a printing condition which is preset by the combination of the consumables, and printing with the setup condition by a user's printing command.

In a preferred embodiment of the present invention, the recognition device reads the grade of the consumables using a memory chip and/or a structural shape.

In the preferred embodiment of the present invention, the consumables comprise at least one of a developing roller, a toner, and a transfer roller.

In addition, the image forming apparatus which operates according to grades of consumables, comprises a recognition device capable of recognizing the grades of the consumables, a memory storing image printing information with respect to combinations of the plurality of consumables, and a main control unit determining the grades of the consumables through the recognition device, and printing the image with the information read from the memory.

The recognition device reads the grade of the consumables using a memory chip or a structural shape, and the consumables comprise at least one of a developing roller, a toner, and a transfer roller.

BRIEF DESCRIPTION OF THE DRAWINGS

The above object and other features of the present invention will become more apparent by describing in detail exemplary embodiments thereof with reference to the attached drawings.

DETAILED DESCRIPTION OF THE PREFERRED EMBODIMENTS

Hereinafter, an embodiment of the present invention will be described in detail with reference to the accompanying drawings.

Figure 1:
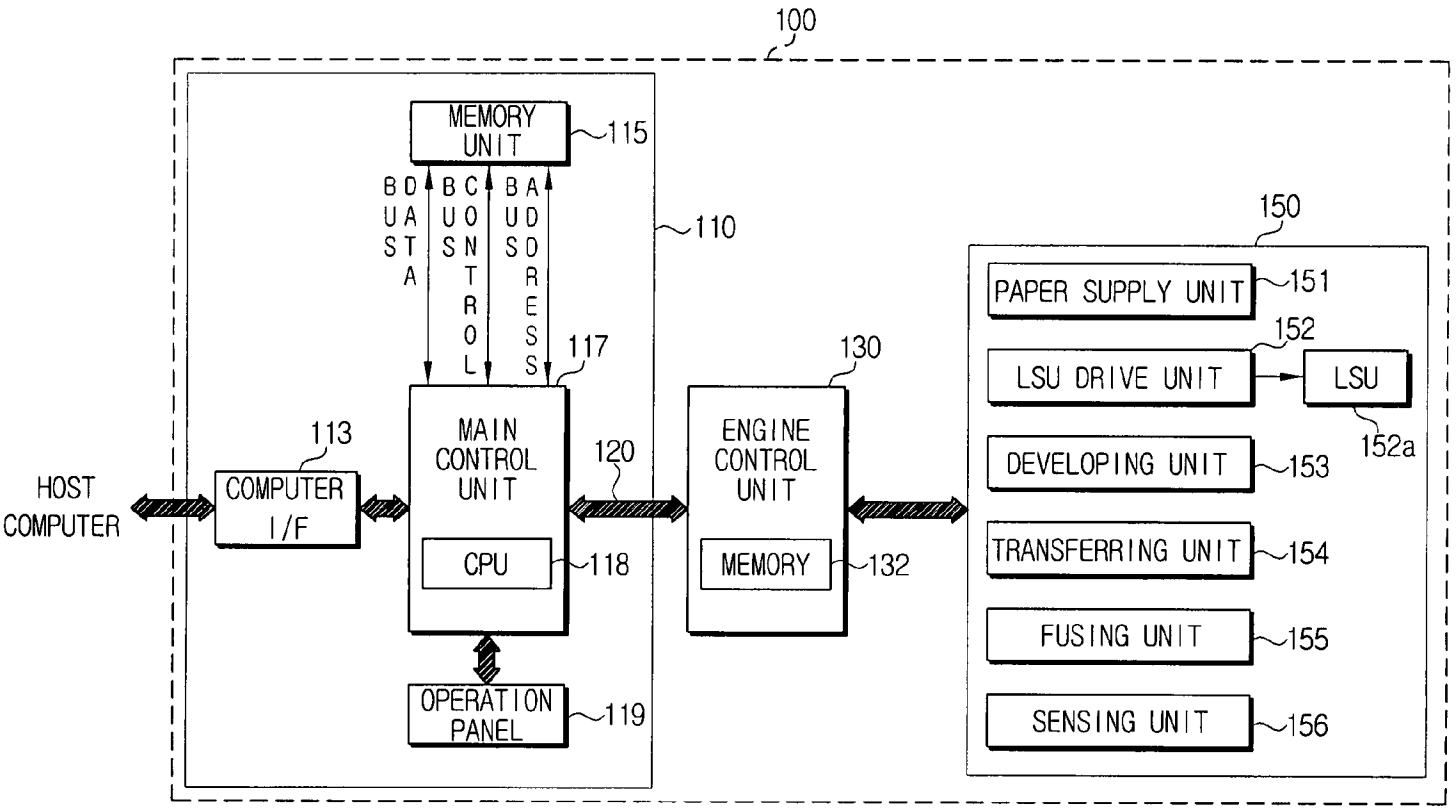
FIG. 1 (PRIOR ART)
FIG. 1 is a block diagram of a laser beam printer as a general image forming apparatus.
Figure 2:
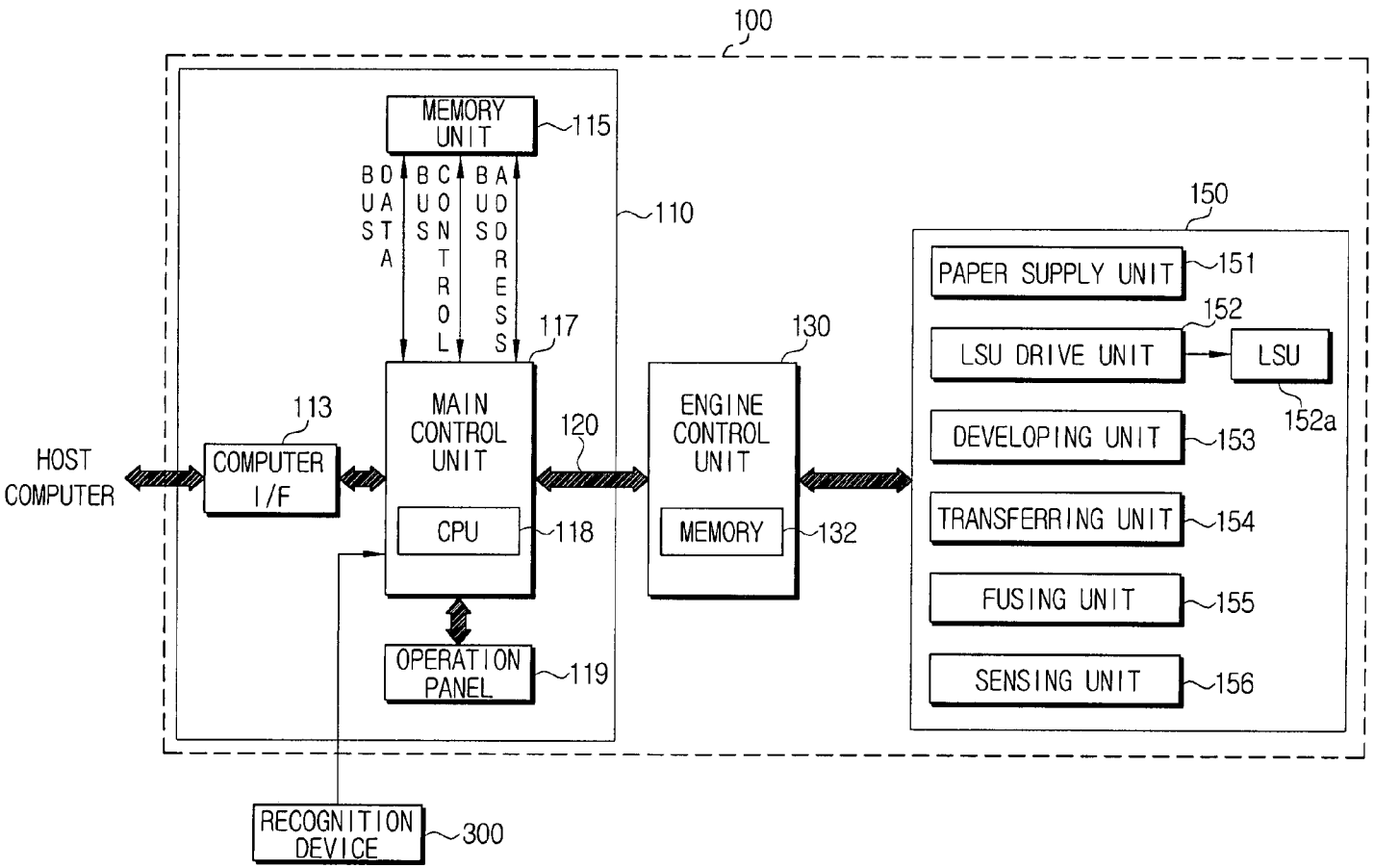
FIG. 2 is a block diagram of an image forming apparatus according to an embodiment of the present invention.

The embodiment of the present invention is applicable for general image forming apparatuses, and in this embodiment, it is applied to a conventional laser beam printer of FIG. 1 by way of example. Therefore, only the main control unit 117, memory unit 115, engine control unit 130, a grade indication device 210 (see FIGS. 4, 6A and 6B, and a recognition device 300 will be explained, while the other known elements will not be described for conciseness.

Figures 4, 5:
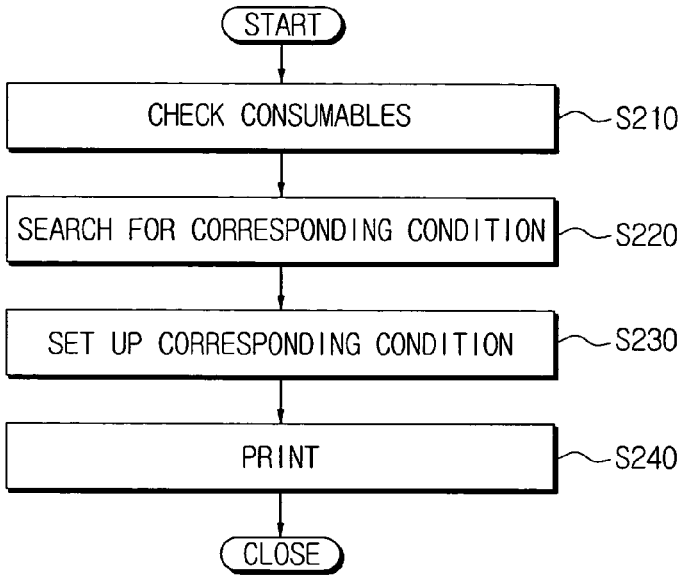
FIG. 4 is a flowchart illustrating a process for grading the consumables for the optimum printing according to an embodiment of the present invention.
FIG. 5 is a combination table for each of the consumables according to an embodiment of the present invention.

The memory unit 115 stores the combination table of FIG. 5 to determine the optimum condition for each grade of the consumables, and the grade indication device 210 of the consumables 200 indicates the grade of the corresponding consumables 200. The recognition device 300 determines the grade of the mounted consumables 200 from the grade indication device 210, and sends it to the main control unit 117. The main control unit 117 determines the grade of the consumables 200 from the grade indication device 210 through the recognition device 300, reads the optimum condition for each grade from the combination table in the memory unit 115, and sends the read condition to the engine control unit 130. Upon receipt of the data regarding optimum printing, the engine control unit 130 controls respective devices of the engine mechanism 150, and outputs a corresponding screen.

Figure 3:
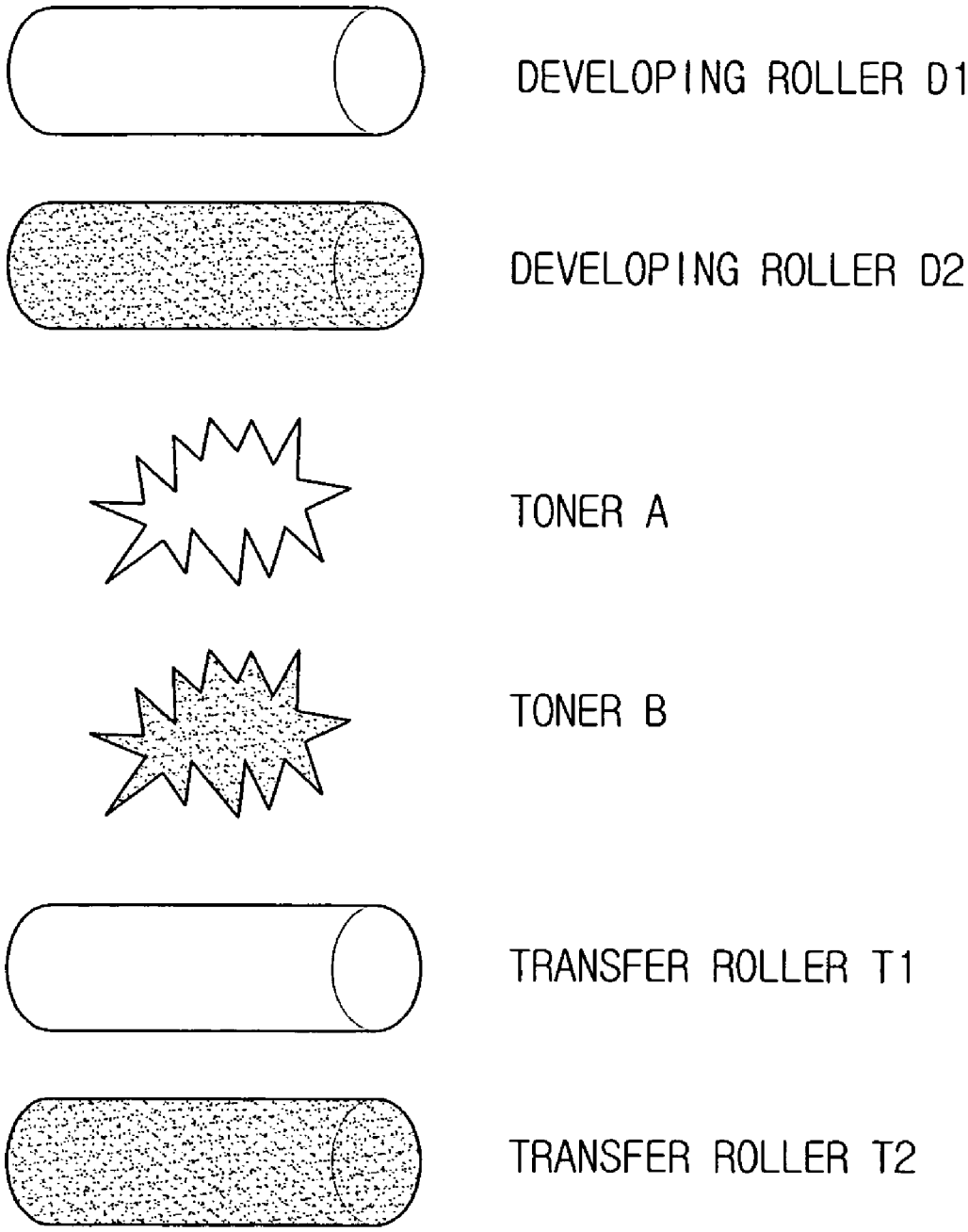
FIG. 3 is a drawing of assorted consumables of the image forming apparatus depicted in FIG. 2.

In this embodiment of the present invention, for example, two kinds of each consumables will be described. The consumables are developing rollers D1 and D2, toners A and B, and transfer rollers T1 and T2, as shown in FIG. 3. The developing roller D1, the toner A, and the transfer roller T1 are superior respectively to the developing roller D2, the toner B, and the transfer roller T2 in quality. The developing rollers D1 and D2 can be usually graded as a single-layer roller and a multi-layer roller. Alternatively, the developing rollers can be graded according to a constituent material, an additive, or a coating method. For example, the grade of the developing rollers can be determined according to whether it is made of a natural gum or a urethane, or whether it is coated by a fluorine or a urethane. The transfer rollers T1 and T2 can be graded by the material, or the manufacturing method, for example. The toner A and B can be graded according to distribution of particles, or a substance and quantity of an additive. If the toner is a color toner, its grade can be determined, for example, according to a pigment. The consumables are usually provided by a distributing company, in a plurality of different types, with many different grades of functions and prices.

Since the respective consumables comprise the grade indication device 210, the main control unit 117 of the image forming apparatus can determine the setup condition according to the mounted consumables through the recognition device 300. For the grade indication device 210, a memory chip can be attached to the consumables such that the recognition device 300 of the main control unit 117 reads and recognizes the grade of the mounted consumables. Alternatively, a specific part of the consumables can be formed in different shapes such that the specific part touches a sensor of the apparatus, and therefore, the grade of the mounted consumables can be recognized.

In one embodiment of the present invention, a memory chip is installed in a toner cartridge. Accordingly, by way of example only, the consumables 200 will be referred to as a toner cartridge 200 hereinafter.

Figure 6A:
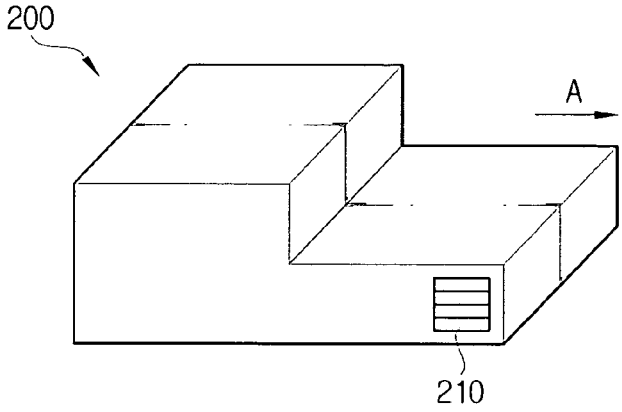
FIGS. 6A and 6B show a device for indicating a grade of the consumables according to an embodiment of the present invention.
Figure 6B:
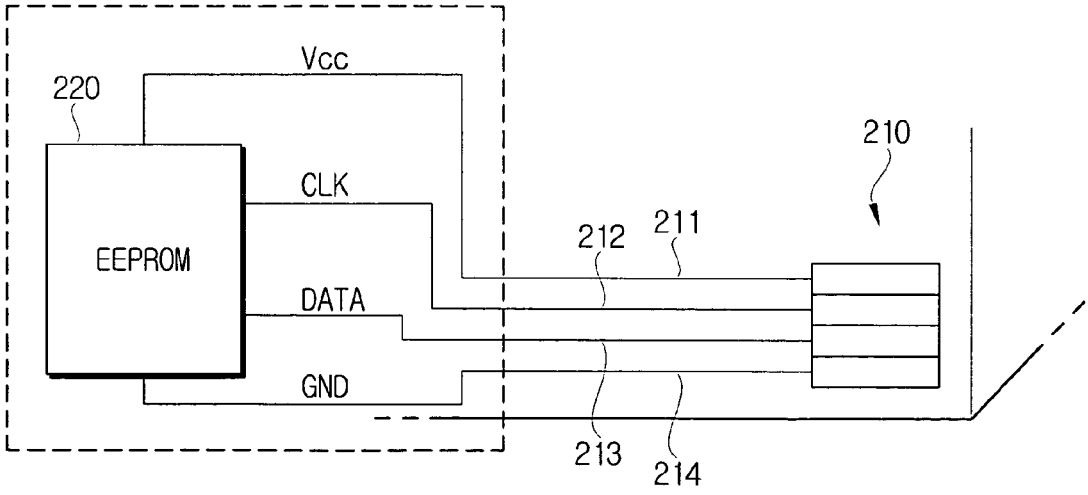

As shown in FIG. 6A, the toner cartridge 200 comprises a data receiving unit as the grade indication device 210 at one end to enable the image forming apparatus to recognize the grade of the toner cartridge. The data receiving unit comprises four pins 211, 212, 213, and 214, as shown in FIG. 6B. These four pins are respectively used as a power supplying pin (Vcc) 211, a clock pin for synchronization (CLK) 212, a data pin 213, and a ground pin (GND) 214. The pins 211, 212, 213, and 214 are connected to an electrically erasable and programmable read only memory (EEPROM) 220. The EEPROM 220 is a memory which stores image printing information according to the grade of the consumables. If the cartridge having the above structure is mounted in the image forming apparatus, the grade indication device 210 is connected at the recognition device 300 as a circuit. The image printing information according to the grade of the consumable is stored in the EEPROM 220, and is transmitted to the image forming apparatus. Then, the main control unit 117 reads the optimum printing condition from the memory 115 according to the data for each grade of the consumables, and outputs the read information to the engine control unit 130. The printing work is then performed. For the recognition device 300, various general discriminating devices can be adequately used according to the grade indication device 210. As one skilled in the art can appreciate, the use of discriminating devices according to the grade indication device is well known, and its description will therefore be omitted for conciseness.

Since the consumables described above can be mounted in a single common image forming apparatus, the main control unit 117 determines the grade of the mounted consumables, and searches for the optimum printing condition from the memory 115 which stores the combination table for each grade of the consumables. The combination table is constructed by the grade of the mounted consumables, and the optimum printing conditions for each combination in the table are stored in the memory 115 when the memory 115 is manufactured. The data that optimizes printing quality is determined experimentally, and stored in the memory 115. This data includes settings for various printing parameters that can include the bias voltage, laser power (which determines the intensity of radiation of a laser diode), and a fusing temperature. For instance, if a user wants to print a high quality image or document, regardless of the cost, the user can select the list "A" (see FIG. 5) consisting of the toner A, the developing roller D1 (indicated by a "1" in the "developing roller" column), and the transfer roller T1 (indicated by a "1" in the "transfer roller" column). The main control unit 117 reads and transmits to the engine control unit 130 the printing condition corresponding to the list "A". The engine control unit 130 controls the system so that the engine mechanism 150 is driven in the printing condition. Alternatively, if the user emphasizes low cost versus high quality, the user can select the list "H", consisting of the toner B, the developing roller D2 (indicated by a "2" in the "developing roller" column), and the transfer roller T2 (indicated by a "2" in the "transfer roller" column).

Accordingly, as the user selectively mounts the consumables depending on a particular need, the image forming apparatus recognizes the grades of the consumables, and performs the printing work with the optimum condition obtained from the combination table of FIG. 5.

Hereinafter, the process to obtain the optimum condition for each grade of the consumables will be described with reference to FIG. 4.

When the image forming apparatus is applied with an electric power, the main control unit 117 of the image forming apparatus determines the grades of the mounted consumables through the grade indication device 210 and the recognition device 300 (step S210). Next, the main control unit 117 searches for the optimum setup condition for the mounted consumables using the combination table (FIG. 5) stored in the memory 115 (step S220). Accordingly, the conditions for the optimum printing are setup, such as the bias voltage, the laser power, the fusing temperature or other conditions (step S230). More specifically, if the combination consists of the toner A, the developing roller D1, and the transfer roller T1, the bias voltage is set to 500V, the laser power is set to 0.11 mA, and the fusing temperature is set to 230° C. Accordingly, the main control unit 117 sets up and transmits to the engine control unit 130 the above conditions when the user desires to print an image or document. The engine control unit 130 controls the engine mechanism 150 according to the printing conditions. As a result, the optimum printing as desired is obtained (step S240).

As described so far with reference to exemplary embodiments of the present invention, the optimum printing conditions with respect to all the combination cases of the consumables to be mounted are determined and set up in the laboratory through experiments during a product developing process, so that the optimum printing conditions can be set according to the grade of the consumables. The laboratory stores the set conditions to a storage area in the apparatus for later use. Therefore, the optimum printing conditions can be set up and stored before the purchase, for example, when the apparatus is manufactured.

As one skilled in the art can appreciate, the consumables can be graded in several grades by functions and prices, although the embodiments described above use only two grades for each consumable. The example of only two is not intended to be a limiting feature of the embodiments of the present invention. The setup conditions of some consumables may not be changed. Additionally, the setup conditions of the apparatus can be more variously applied than described in this embodiment. Furthermore, other types of the consumables can be provided and accounted for in the table of FIG. 5, and therefore the examples of the developing roller, the transfer roller, and the toner as described in this embodiment of the present invention are not intended to be limiting features of the embodiments of the present invention.

According to the embodiments of the present invention, with a single image forming apparatus, the user can adaptively use consumables as desired by selecting the right grade of the consumables as necessary. Preference of the user between low cost and high quality can be satisfied with the single image forming apparatus. Furthermore, such an apparatus and method for selecting the grade of consumables is economical since the user does not have to purchase a plurality of image forming apparatuses to accommodate users' various preferences regarding printing quality and cost.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A printing method of an image forming apparatus which has a recognition device to discriminate mounted consumables according to respective grades, the method comprising the steps of:

storing at least one preset printing condition with respect to at least one combination of consumables as a correlation table reflecting printing conditions, consumable grades, and consumable combinations;

determining a grade of at least one mounted consumable by a recognition device;

searching for a preset printing condition of the apparatus, through which a printing condition can be selected, with the mounted consumable combination and determined grade information of the at least one mounted consumable;

setting a preset printing condition for the mounted consumable combination and determined grade of the at least one mounted consumable; and printing according to the selected printing condition.

2. The printing method according to claim 1, wherein the selected preset printing condition comprises:

a condition ranging from an optimum printing condition, regardless of cost and time to print, to a cost-effective printing condition, regardless of print quality.

3. The printing method according to claim 1, further comprising:

determining at least one printing condition with respect to at least one grade of at least one mounted consumable; and storing the determined at least one printing condition with respect to different grades and combinations of at least one mounted consumable in a memory storage device in the image forming apparatus.

4. The method of printing according to claim 3, wherein the step of storing the determined at least one printing condition with respect to different grades and combinations of at least one mounted consumable in a memory storage device in the image forming apparatus comprises:

storing the determined printing conditions in a table format comprising at least one type of print quality versus at least one different grade of at least one different consumables.

5. The printing method of claim 1, wherein the recognition device determines the grade of the consumables using a memory chip and/or a structural shape.

6. The printing method of claim 1, wherein the consumables are at least one of a developing roller, a toner, and a transfer roller.

7. An image forming apparatus which operates according to grades of at least one consumable mounted therein, comprising:

a recognition device for recognizing grades of at least one mounted consumable;

a memory storage device for storing at least one preset image printing condition with respect to combinations of mounted consumables as a correlation table reflecting printing conditions, consumable grades, and consumable combinations; and a main control unit for determining the grades of the mounted consumables through the recognition device, searching the memory storage device for a preset image printing condition using the determined grade information of the at least one mounted consumable and mounted consumable combination, and printing the image with a selected image printing condition read from the memory storage device.

8. The image forming apparatus of claim 7, wherein the recognition device determines the grade of the consumables using a memory chip and/or a structural shape.

9. The image forming apparatus of claim 7, wherein the consumables are at least one of a developing roller, a toner, and a transfer roller.

* * * * *